US007830404B2

(12) United States Patent
Yamada

(10) Patent No.: US 7,830,404 B2
(45) Date of Patent: Nov. 9, 2010

(54) PRINTER AND CONTROL METHOD THEREOF

(75) Inventor: Satoshi Yamada, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/400,042

(22) Filed: Mar. 9, 2009

(65) Prior Publication Data

US 2010/0033547 A1 Feb. 11, 2010

(30) Foreign Application Priority Data

Aug. 8, 2008 (JP) ..... 2008-205911

(51) Int. Cl.
*B41J 3/60* (2006.01)
*B41J 3/54* (2006.01)

(52) U.S. Cl. ..... 347/171; 400/188; 400/82

(58) Field of Classification Search ..... 347/171, 347/1, 5, 9; 400/82, 188
See application file for complete search history.

(56) References Cited

U.S. PATENT DOCUMENTS 5,284,816 A * 2/1994 Stephenson ..... 503/227
2007/0273743 A1* 11/2007 Yamada et al. ..... 347/192

FOREIGN PATENT DOCUMENTS

| | | | |
|---|---|---|---|
| EP | 0947340 | * 10/1999 | |
| EP | 1862318 | 1/2008 | |
| JP | 57-69071 | * 4/1982 | ..... 400/82 |
| JP | 11-286147 | 10/1999 | |
| JP | 2007313850 | 12/2007 | |
| WO | 2008079153 | 7/2008 | |

OTHER PUBLICATIONS

European Search Report For 09003314 Mailed Sep. 17, 2010.

* cited by examiner

*Primary Examiner*—Huan H Tran
(74) *Attorney, Agent, or Firm*—Turocy & Watson, LLP

(57) ABSTRACT

A printer includes a first print head that performs printing on one side surface of the print medium and a second print head that performs printing on the other side surface of the print medium and abnormality detection sensors that are attached respectively to the first and second print heads. A printer performs control such that in the case where any abnormality is detected in one of the first and second print heads, print data to be printed using one print head in which the abnormality has been detected is printed using the other print head which is normally operating.

13 Claims, 3 Drawing Sheets

PRINTER AND CONTROL METHOD THEREOF

CROSS-REFERENCE TO RELATED APPLICATIONS

This application is based upon and claims the benefit of priority from the prior Japanese Patent Application No. 2008-205911, filed on Aug. 8, 2008, the entire contents of which are incorporated herein by reference.

BACKGROUND OF THE INVENTION

1. Field of the Invention

The present invention relates to a printer provided with two print heads and a control method thereof.

2. Description of the Related Art

Currently, a thermal printer is used to print a receipt with a register in a restaurant and a store. Usually single-side printing is done to the receipt, and a large amount of receipt paper is used in the case of printing a large amount of information, resulting in uneconomical increase of cost.

Therefore, sometimes a double-side simultaneous printing thermal printer is used so as to effectively print information on a receipt paper as much as possible. In the thermal printer of such a type, print data is divided into data groups to be printed on front surface and back surface of a thermal paper respectively. Then, printing is carried out simultaneously on the both surfaces of the thermal paper, whereby the data groups are integrated. As an example of the thermal printer of such a type, a thermal printer including two platen rollers and two thermal heads has been proposed (Jpn. Pat. Appln. Laid-Open Publication No. 11-286147).

In such kind of thermal printer, the first platen roller and the second platen roller are rotated at the same speed while being synchronous with each other. The first thermal head carries out the printing on one of the surfaces of the thermal paper by the passage of the thermal paper between the first platen roller and the first thermal head. The second thermal head carries out the printing on the other surface of the thermal paper by the further passage of the thermal recording paper between the second platen roller and the second thermal head.

However, in the thermal printer having the two thermal heads (first and second thermal heads), if there occurs any abnormality in one of the thermal heads, print head error is detected to stop the entire operation of the printer. Thus, the printer cannot perform the subsequent printing until the print head error is eliminated.

In this case, a user needs to contact a serviceman for correction of the print head error. That is, the user cannot use the printer until the print head error is eliminated by the serviceman.

BRIEF SUMMARY OF THE INVENTION

It is an object of the present invention to provide a printer including a two print heads and capable of continuing a printing process, even if any abnormality occurs in one of the two print heads, by means of the other normal print head, including print data of the abnormal print head.

In an aspect of the present invention, a printer includes: a print medium feeding means for feeding a print medium which is a double-sided printable continuous form paper; a first print head that performs printing on one side surface of the print medium; a second print head that performs printing on the other side surface of the print medium; abnormality detection sensors that are attached respectively to the first and second print heads and perform abnormality check for the first and second print heads; and a controller that performs control such that in the case where any abnormality is detected in one of the first and second print heads by one of the abnormality detection sensors, print data to be printed using one print head in which the abnormality has been detected is printed using the other print head which is normally operating.

BRIEF DESCRIPTION OF THE DRAWINGS

FIGS. 5A and 5B are views showing an example in which print data is printed on both surfaces of a thermal paper, in which FIG. 5A shows the front surface, and FIG. 5B shows the back surface;

DETAILED DESCRIPTION OF THE INVENTION

Throughout this description, the embodiments and examples shown should be considered as exemplars, rather than limitations on the apparatus and methods of the present invention.

A printer according to an embodiment of the present invention will be described below by taking a thermal printer as an example.

Figure 1:
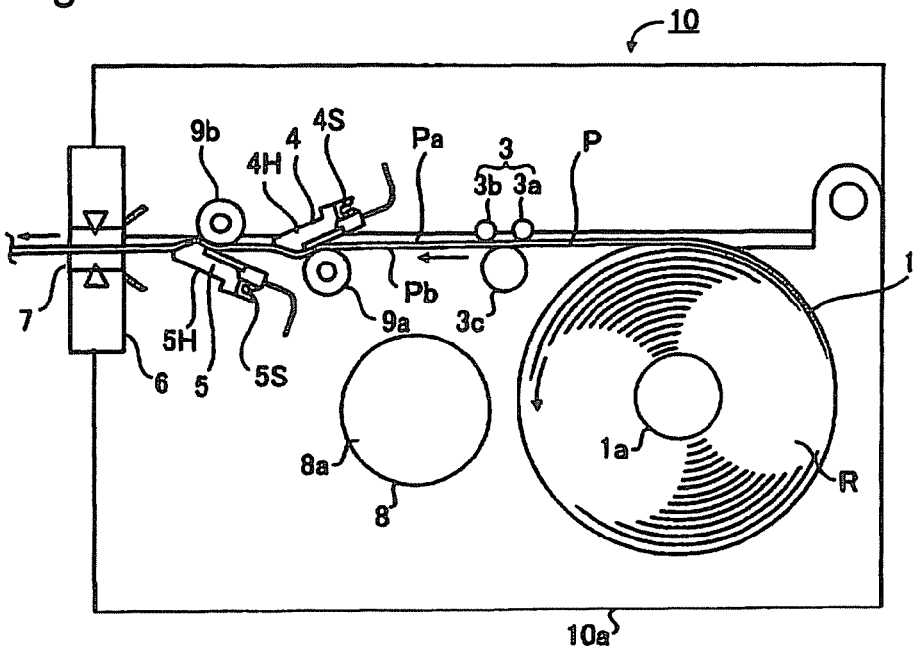
FIG. 1 is a view showing a configuration of the main part of a thermal printer according to an embodiment of the present invention.

FIG. 1 is a view showing a configuration of the main part of a thermal printer. A thermal printer 10 has a casing 10*a* in which respective components are housed and arranged. On one end side of the casing 10*a*, a thermal paper supply section 1 for holding and supplying a roll of thermal paper P (print medium) used in the thermal printer is arranged. The thermal paper supply section 1 includes a holder portion 1*a* for holding a thermal paper roll R and a feeding mechanism 3 (print medium feeding means) for feeding the thermal paper P from the holder portion 1*a* to a printing section along a paper feed path. The feeding mechanism 3 includes rollers 3*a*, 3*b* and a damper 3*c* which are so arranged as to face each other across a paper feed path 2 extending from the thermal paper supply section 1 to the other end of the casing 10*a*. The damper 3*c* is a pressure member that applies a certain pressing force to the thermal paper P. On the downstream side in the feeding direction of the thermal paper P relative to the thermal paper supply section 1, a first printing section 4, a second printing section 5, a cutter 6, and a discharge port 7 are arranged along the paper feed path 2 in the order from the upstream side.

Further, in the casing 10*a*, a drive section 8 for driving the respective components is provided. The drive section 8 includes a drive motor 8*a* and a drive transmission section (not shown), such as a gear mechanism, for transmitting driving power generated by the drive motor 8*a*.

The first printing section 4 includes a first thermal head 4H that contacts the front surface Pa of the thermal paper P to perform printing on the front surface Pa. Similarly, the second printing section 5 includes a second thermal head 5H that contacts the back surface Pb of the thermal paper P to perform printing on the back surface Pb. The first and second thermal heads 4H and 5H each have a large number of heater elements (not shown in FIG. 1) arranged in the direction perpendicular to the feeding direction of the thermal paper P and are arranged away from each other in the feeding direction of the thermal paper P.

The thermal heads 4H and 5H are each, e.g., of a type in which a large number of heater elements are provided on a ceramic substrate. The heater elements are linearly arranged in the main scanning direction at a density of, e.g., 600 dpi (dot per inch). Each of the heater elements is made of an electrical resistance material such as TaSiO, TiSiO, or TiC-SiO. Thus, when power is supplied from a power source, the heater elements are joule-heated and increased in temperature to a predetermined temperature required for allowing printing on a recording medium such as the thermal paper P.

A first temperature sensor 4S (abnormality detection sensor) and a second temperature detection sensor 5S (abnormality detection sensor) are attached to the first thermal head 4H and second thermal head 5H, respectively. The temperatures of the first and second thermal heads 4H and 5H are detected by the first and second temperature sensor 4S and 5S. The two temperature sensors 4S and 5S are both thermistors.

The thermistors used as the two temperature sensors 4S and 5S are each made of an electrical resistance material whose resistance value significantly changes with a change in the temperature. An example of such electrical resistance material includes a temperature-sensitive semiconductor including oxide of transitional metal such as Mn, Ni, Co, Fe, or Cr. A predetermined voltage is applied between a pair of electrode terminals provided on the surface of the thermistor, and the amount of energization is measured, whereby the temperature can be detected.

Based on the temperature information acquired by the thermistors, the following various control processing are performed for the purpose of improving printing quality and safety.

A first platen roller 9*a* is arranged opposite to the first thermal head 4H across the thermal paper P, and a second platen roller 9*b* is arranged opposite to the second thermal head 5H across the thermal paper P. The thermal paper P is brought into tight contact with the opposing thermal heads 4H and 5H by the two platen rollers 9*a* and 9*b* so that satisfactory high resolution printing image is obtained. Further, on the downstream side relative to the first thermal head 4H in the feeding direction of the thermal paper P, a cutter 6 for cutting the thermal paper P at its rear side (upstream side) relative to the print area is arranged.

The thermal paper P used in this thermal printer 10 has a thermal layer formed respectively on one surface (front surface) Pa and the other surface (back surface) Pb. The thermal paper P is wound in a roll shape such that the front surface Pa faces the outside. The thermal layer is formed of a material that develops color (black or red, etc.) when heated to a predetermined temperature or more.

Next, a control method of the thermal printer 10 having the above configuration will be described.

Figure 2:
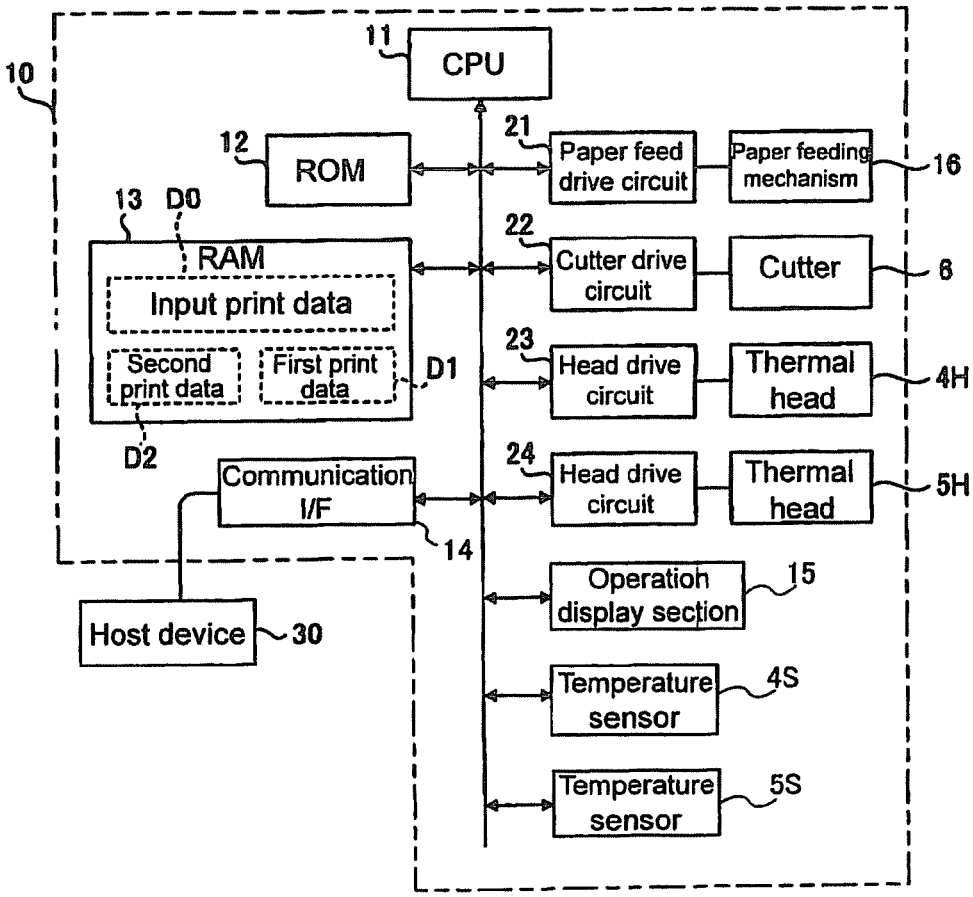
FIG. 2 is a control block diagram of the thermal printer according to the embodiment.

FIG. 2 is a control block diagram of the thermal printer 10. As shown in FIG. 2, connected to a bus line of a CPU 11 as a main control unit are a ROM 12 which is a memory for storing a control program, a RAM 13 which is a memory for storing data, a communication interface 14 for exchanging data with a host device 30, an operation display section 15 for setting operational condition, a paper feed drive circuit 21 for driving a paper feeding mechanism 16 for feeding the thermal paper P, a cutter drive circuit 22 for driving the cutter 6, a first head drive circuit 23 for driving the first thermal head 4H in accordance with later-described first print data D1, a second head drive circuit 24 for driving the second thermal head 5H in accordance with later-described second print data D2, and the temperature sensors 4S and 5S.

The CPU 11 performs the following control processing (1) to (6) as primary functions.

(1) To divide the print data D0 input from the external host device 30 into the first print data D1 to be printed on the front surface Pa of the thermal paper P and second print data D2 to be printed on the back surface Pb of the thermal paper P.

(2) To control energization ON/OFF for the heater elements of the first thermal head 4H in accordance with the first print data D1 and control energization ON/OFF for the heater elements of the second thermal head 5H in accordance with the second print data D2.

(3) To control the power-on time for the heater elements of the first thermal head 4H such that detection temperature T1 of the temperature sensor 4S becomes a previously defined setting value T1*s* and control the power-on time for the heater elements of the second thermal head 5H such that detection temperature T2 of the temperature sensor 5S becomes a previously defined setting value T2*s*.

(4) To start driving the first thermal head 4H in accordance with the first print data D1 while feeding the thermal paper P and then start driving the second thermal head 5H in accordance with the second print data D2 when the printing start position based on the drive of the first thermal head 4H reaches the position corresponding to the second thermal head 5H.

(5) To stop driving the first and second thermal heads 4H and 5H for safety when the detection temperature T1 of the first temperature sensor 4S abnormally increases and reaches an upper limit value T1 max or when the detection temperature T2 of the second temperature sensor 5S abnormally increases and reaches an upper limit value T2 max and to display corresponding information on the operation display section 15 for notification.

(6) To stop driving one of the thermal head 4H and thermal head 5H when one of the detection temperatures T1 and T2 of the temperature sensors 4S and 5S of the thermal heads 4H and 5H abnormally increases or does not reach a predetermined temperature, or when dot dropout or cable disconnection occurs in one of the thermal heads 4H and 5H and to use only one of the thermal heads 4H and 5H that is normally operating to perform printing including the print data of the head in which the abnormality has occurred.

The control processing of (6) will be described in detail later.

Figure 3:
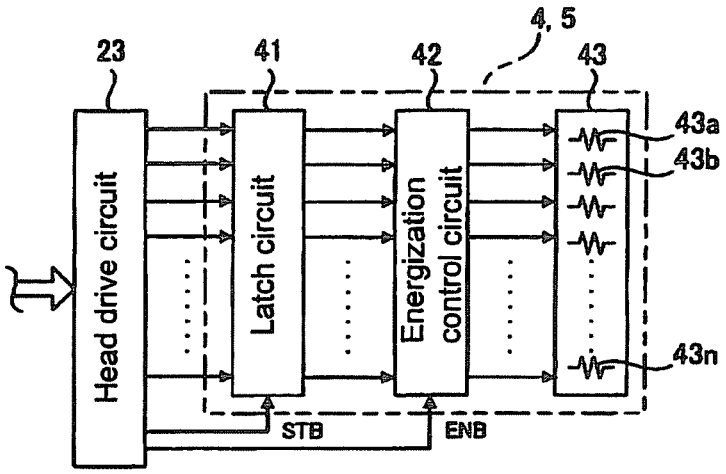
FIG. 3 is a view showing a configuration of a thermal head used in the thermal printer according to the embodiment.

The first and second thermal heads 4H and 5H each have a configuration as shown in FIG. 3. As shown in FIG. 3, the thermal heads 4H and 5H each includes a latch circuit 41, an energization control circuit 42, and an edge head 43.

The edge head 43 has a large number of heat-transfer heater elements 43*a*, 43*b*, . . . , 43*n* that are linearly arranged. The latch circuit 41 latches, line by line, the first print data D1 supplied from the head drive circuit 23 in accordance with a strobe signal STB supplied from the head drive circuit 23. The energization control circuit 42 controls ON/OFF of energization with respect to the heater elements 43*a*, 43*b*, . . . , 43*n* of the edge head 43 in accordance with data in the latch circuit 41 at a timing at which an enable signal ENB (signal enabling the use of a specific circuit) supplied from the head drive circuit 23 becomes active.

By changing the time length during which the enable signal ENB becomes active, the energization-ON timing with respect to the heater elements changes. When the energizing-ON timing changes, temperature at which each heater produces heat changes.

Next, operation will be described.

When one printing job, i.e., the print data D0 which is one block of print data is input to the thermal printer from the external host device 30, the print data D0 is stored in the RAM 13. In accordance with this storage, the print data D0 is divided into the first print data D1 and second print data D2. The dividing ratio or dividing condition is set by a user's operation on the operation display section 15 or an instruction from the host device 30. For example, the dividing ratio may be set to 50:50, and dividing condition may be set to data type. An example of the data type includes, (in the case of a receipt issued in a store), transaction content, announcement for customers, advertisement for customers, and illustration. In addition to the above configuration, needless to say, the print data D0 may be handed over from the external device 30 to the thermal printer 10 in a handshaking manner.

Figure 4:
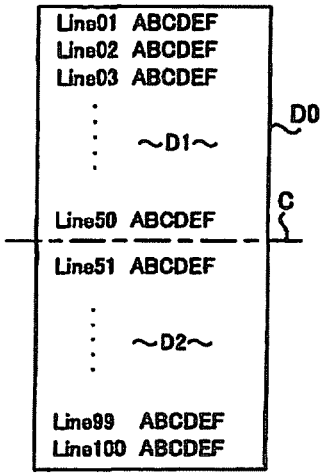
FIG. 4 is a view showing an example in which print data is divided in the thermal printer according to the embodiment.

An example in which the print data D0 is divided into the first print data D1 and second print data D2 is shown in FIG. 4.

As shown in FIG. 4, the print data D0 composed of print data of 1 st to 100 th lines is divided into the first print data D1 composed of print data of 1 st to 50 th lines and second print data D2 composed of print data of 51 st to 100 th lines at a center line C. The first and second print data D1 and D2 are stored in the RAM 13. If data exists on the center line C, the data on the center line is sorted to one of the first and second print data D1 and D2 according to a previously set condition.

After this division, feeding of the thermal paper P is started, and driving of the first thermal head 4H corresponding to the first print data D1 is first commenced, whereby the print data of 1 st to 50 th lines is printed on the front surface Pa of the thermal paper P. When the thermal paper P advances, and the printing start position based on the drive of the first thermal head 4H reaches the position corresponding to the second thermal head 5H, driving of the second thermal head 5H corresponding to the second print data D2 is started, whereby the print data of 51 st to 100 th lines is printed on the back surface Pb of the thermal paper P.

Figure 5A:
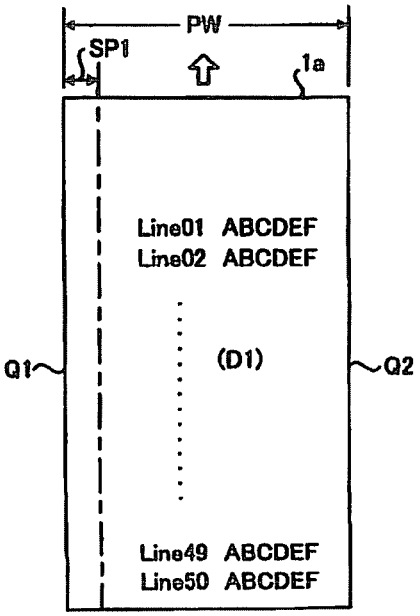
Figure 5B:
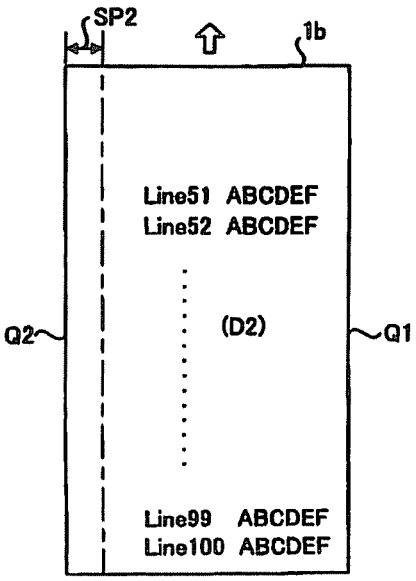

In this manner, as shown in FIG. 5A, the first print data D1, i.e., print data of 1 st to 50 th lines is printed on the front surface Pa of the thermal paper P having a predetermined paper width PW. Further, as shown in FIG. 5B, the second print data D2, i.e., print data of 51 st to 100 th lines is printed on the back surface Pb of the thermal paper P. In this case, in the front surface Pa of the thermal paper P, a blank area having a width of SP1 is provided between the start position of each text line to be printed and one end Q1 of the thermal paper P in the width direction. Similarly, in the back surface Pb of the thermal paper P, a blank area having a width of SP2 is provided between the start position of each text line to be printed and the other end Q2 of the thermal paper P in the width direction.

The printed thermal paper P is cut by the cutter 6 and discharged from the discharge port 7 to be provided as, e.g., a sales receipt to a customer.

Next, the abovementioned control processing of (6), i.e., "to stop driving one of the thermal head 4H and thermal head 5H when one of the detection temperatures T1 and T2 of the temperature sensors 4S and 5S of the thermal heads 4H and 5H abnormally increases or does not reach a predetermined temperature, or when dot dropout or cable disconnection occurs in one of the thermal heads 4H and 5H and to use only one of the thermal heads 4H and 5H that is normally operating to perform printing" will be described.

Figure 6:
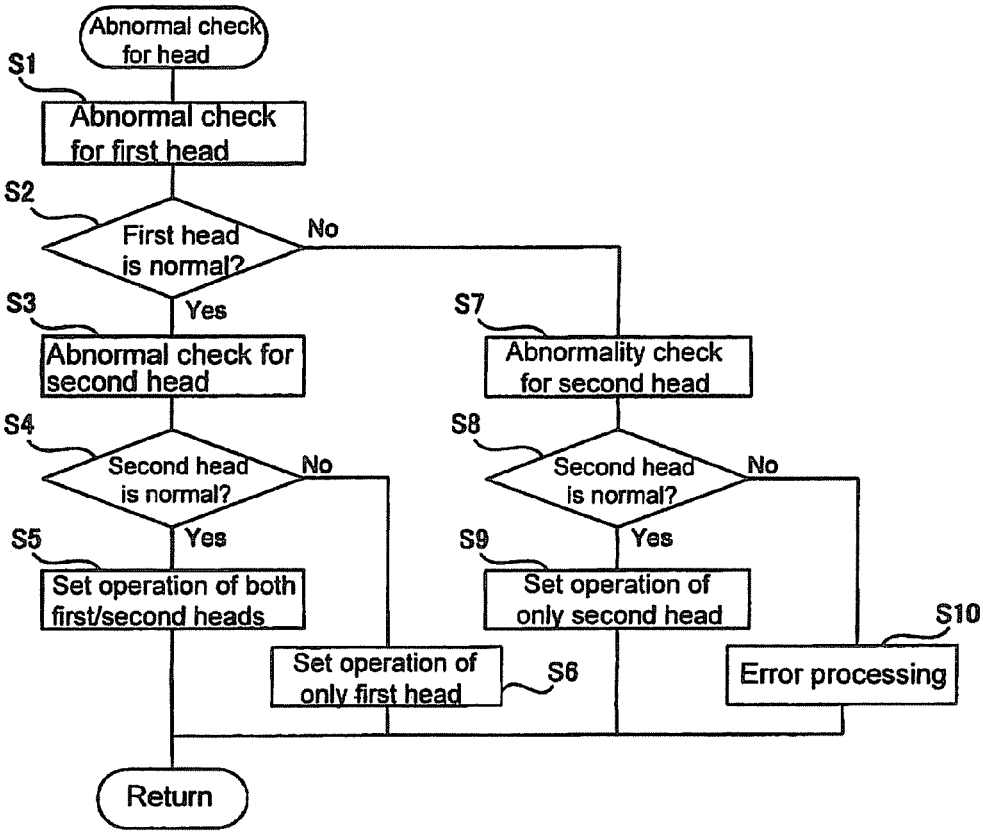
FIG. 6 is a flowchart showing a procedure of detecting abnormality in the thermal head of the thermal printer according to the embodiment.

First, a procedure of detecting abnormality in the thermal heads 4H and 5H will be described. FIG. 6 is a flowchart showing a procedure of detecting abnormality in the thermal heads 4H and 5H.

First, the first temperature sensor 4S is used to perform abnormality check for the first thermal head 4H (step S1).

Then, based on a result of the abnormality check, it is determined whether the first thermal head 4H is normal or not (step S2).

When it has been determined that the first thermal head 4H is normal, the second temperature sensor 5S is used to perform abnormality checking for the second thermal head 5H (step S3).

Then, based on a result of the abnormality check, it is determined whether the second thermal head 5H is normal or not (step S4).

When it has been determined that the second thermal head 5H is normal, operation of both the first and second thermal heads 4H and 5H is set (step S5).

When it has been determined in step S4 that the second thermal head 5H is abnormal, which means that only the first thermal head 4H is normal, so operation of only the first thermal head 4H is set (step S6).

When it has been determined in step S2 that the first thermal head 4H is abnormal, the second temperature sensor 5S is used to perform abnormality checking for the second thermal head 5H (step S7).

Then, based on a result of the abnormality check, it is determined whether the second thermal head 5H is normal or not (step S8).

When it has been determined that the second thermal head 5H is normal, operation of only the second thermal head 5H is set (step S9).

When it has been determined in step S8 that the second thermal head 5H is abnormal, which means that both the first and second thermal heads 4H and 5H are abnormal and the printing operation cannot be continued, so error processing is performed to end the printing processing (step S10).

Next, a procedure of printing processing based on the result of the abovementioned abnormality detection procedure will be described.

Figure 7:
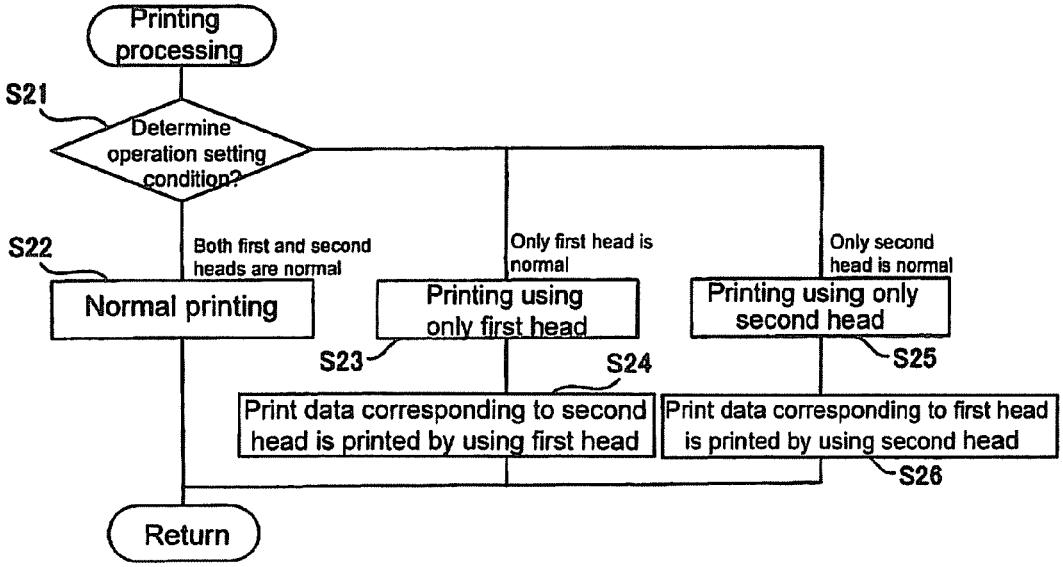
FIG. 7 is a flowchart showing a procedure of printing processing in the thermal printer according to the embodiment.

FIG. 7 is a flowchart showing a procedure of printing processing.

First, it is determined that which of the following three cases the current printing setting condition corresponds to: (a) case where both the first and second thermal heads 4H and 5H are normal; (b) case where only the first thermal head 4H is normal; and (c) case where only the second thermal head 5H is normal (step S21).

When it is determined that the current printing setting condition is (a): case where both the first and second thermal heads 4H and 5H are normal, the two thermal heads 4H and 5H are used to perform normal printing processing (step S22).

When it is determined that the current printing setting condition is (b): case where only the first thermal head 4H is normal, only the first thermal head 4H is used to perform printing processing (step S23).

In this case, the print data corresponding to the second thermal head 5H is printed using the first thermal head 4H (step S24).

When it is determined that the current printing setting condition is (c): case where only the second thermal head 5H is normal, only the second thermal head 5H is used to perform printing processing (step S25).

In this case, the print data corresponding to the first thermal head 4H is printed using the second thermal head 5H (step S26).

With the above configuration, even if any abnormality occurs in one of the thermal heads 4H and 5H, it is possible to continue printing processing by using only one of the thermal heads 4H and 5H that is normally operating.

When the print data to be printed on both the front and back surfaces Pa and Pb of the thermal paper P using the two thermal heads 4H and 5H needs to be printed on only one of the surfaces Pa and Pb using one of the thermal heads 4H and 5H, division of the print data may be canceled.

That is, as described above, in the case where both the two thermal heads 4H and 5H are used to perform printing processing, the print data D0 is divided into the first and second print data D1 and D2 at the center line C as shown in FIG. 4.

On the other hand, in the case where the printing processing needs to be continued by using only one of the thermal heads 4H and 5H that is normally operating, the setting of the center line C is canceled, with the result that the print data D1 and print data D2 are integrated to one print data D0. Therefore, it is possible to continue the printing processing on one surface using only one of the thermal heads 4H and 5H.

More specifically, when the division of the print data is canceled, the print data D0, which is composed of print data of 1 st to 100 th lines as shown in FIG. 4, is printed on one surface.

Although the thermal printer is used as a printer in the above embodiment, the switching mechanism of the print head according to the present invention can be applied not only to the thermal printer but also to various types of printers. Therefore, the present invention does not limit the type of the printer. Thus, for example, when an ink-jet printer is used as the printer according to the present invention, the same effect as the above embodiment can be obtained.

The present invention is not limited to the above embodiment but various modifications can be made within the scope of the present invention. Further, various inventions can be formed by appropriately combining a plurality of required constituent elements disclosed in the embodiment. For example, some required constituent elements may be omitted from all required constituent elements disclosed in the embodiment. Furthermore, required constituent elements across different embodiments may be appropriately combined.

What is claimed is:

1. A printer comprising:

print medium feeding means for feeding a print medium which is a double-sided printable continuous form paper;

a first print head that performs printing on one side surface of the print medium;

a second print head that performs printing on the other side surface of the print medium;

abnormality detection sensors that are attached respectively to the first and second print heads and perform abnormality check for the first and second print heads; and a controller that performs control such that in the case where any abnormality is detected in one of the first and second print heads by one of the abnormality detection sensors, print data to be printed using one print head in which the abnormality has been detected is printed using the other print head which is normally operating.

2. The printer according to claim 1, comprising a memory that separately stores print data assigned to the first and second print heads for each print head.

3. The printer according to claim 1, wherein the first and second print heads are thermal heads, and the print medium is a thermal paper.

4. The printer according to claim 1, wherein one of the first and second print heads that is normally operating is used to print all the data corresponding to one print job on one side surface of the printing medium.

5. The printer according to claim 1, wherein the controller receives detection information from the abnormality detection sensors before starting one print job.

6. The printer according to claim 5, wherein the controller receives the detection information from the abnormality detection sensors even while processing one print job.

7. The printer according to claim 1, wherein the abnormality detection sensors each determine that any abnormality has occurred when the temperature of the print head exceeds a predetermined temperature.

8. A control method of a printer that performs printing on one side surface of a print medium which is a double-sided printable continuous form paper using a first print head and performs printing on the other side surface of the print medium using a second print head while feeding the print medium, said method comprising:

performing abnormality check for the first and second print heads using abnormality detection sensors attached to the first and second print heads; and printing, in the case where any abnormality is detected in one of the first and second print heads by one of the abnormality detection sensors, print data to be printed using one print head in which the abnormality has been detected by using the other print head which is normally operating.

9. A control method of a printer that performs printing on one side surface of a print medium which is a double-sided printable continuous form paper using a first print head and performs printing on the other side surface of the print medium using a second print head while feeding the print medium, said method comprising:

separately storing print data assigned to the first and second print heads for each print head;

performing abnormality check for the first and second print heads using abnormality detection sensors attached to the first and second print heads; and printing, in the case where any abnormality is detected in one of the first and second print heads by one of the abnormality detection sensors, print data to be printed using one print head in which the abnormality has been detected by using the other print head which is normally operating on the same side surface as the print data printed by using the normal print head from the position following the print data that has been printed.

10. The printer control method according to claim 9, wherein print data to be printed using one print head in which the abnormality has been detected is printed by using the other print head which is normally operating on the same side surface as the print data printed and in the same direction by using the normal print head from the position following the print data that has been printed.

11. The printer control method according to claim 8, wherein the first and second print heads are thermal heads, and the print medium is a thermal paper.

12. The printer control method according to claim 9, wherein the first and second print heads are thermal heads, and the print medium is a thermal paper.

13. The printer control method according to claim 10, wherein the first and second print heads are thermal heads, and the print medium is a thermal paper.

* * * * *